US009682264B1

(12) United States Patent
Chen

(10) Patent No.: US 9,682,264 B1
(45) Date of Patent: Jun. 20, 2017

(54) TRAMPOLINE ENCLOSURE AND PAD SYSTEM

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 15/285,800

(22) Filed: Oct. 5, 2016

Related U.S. Application Data

(63) Continuation-in-part of application No. 15/228,961, filed on Aug. 4, 2016.

(51) Int. Cl.
*A63B 21/00* (2006.01)
*A63B 5/11* (2006.01)
*A63B 71/04* (2006.01)

(52) U.S. Cl.
CPC ..... *A63B 5/11* (2013.01); *A63B 71/04* (2013.01)

(58) Field of Classification Search
CPC ..... A63B 21/00
USPC ..... 482/27, 28, 77, 78
See application file for complete search history.

(56) References Cited

U.S. PATENT DOCUMENTS 6,139,474 A * 10/2000 Gift ..... A63B 5/11 482/27
8,585,557 B2 * 11/2013 Ikegami ..... A63B 5/11 482/27

* cited by examiner

*Primary Examiner* — Jerome W Donnelly
(74) *Attorney, Agent, or Firm* — Clement Cheng

(57) ABSTRACT

A trampoline comprising a trampoline frame having legs. The trampoline frame has a trampoline frame horizontal portion. A trampoline bed is suspended across the trampoline frame horizontal portion. Springs extend between the trampoline frame and trampoline bed. An enclosure is connected to the trampoline frame. The enclosure has an enclosure upper support. The enclosure supports an enclosure net. A pad system covers the springs. The pad system includes a wall pad extending upwardly from the springs and terminating at a pad system apex. The pad system further includes a buttress pad connected to the pad system apex at an apex angle from the wall pad, which is defined as an angle between a wall pad outside surface and the buttress pad. The buttress pad extends downwardly to cover at least partially the trampoline frame horizontal portion.

18 Claims, 3 Drawing Sheets

TRAMPOLINE ENCLOSURE AND PAD SYSTEM

This application is a continuation in part of U.S. patent application Ser. No. 15/228,961 for a Trampoline Enclosure And Pad System filed on Aug. 4, 2016, by inventor Samuel Chen, the disclosure of which is incorporated herein by reference.

FIELD OF THE INVENTION

The present invention is in the field of trampoline enclosure and pad systems.

DISCUSSION OF RELATED ART

Trampoline enclosures and trampoline spring covers have become more prevalent recently. Trampoline spring covers have been made as pads or sheets to cover the trampoline springs. Trampoline enclosures often include netting.

A variety of different trampoline enclosure and pad systems are described in United States patents. For example, Sidlinger in U.S. Pat. No. 3,767,009, issued Oct. 23, 1973, provides for a trampoline spring cover entitled Trampoline Support And Cushioning Means, the disclosure of which is incorporated herein by reference. Inventor Steger in U.S. Pat. No. 6,193,632 provides for A Trampoline Pad Assembly Having Variable Thickness, issued Feb. 27, 2001, entitled trampoline pad assembly, the disclosure of which is incorporated herein by reference. Inventor Gift in U.S. Pat. No. 6,017,292, entitled Method And Apparatus For Attaching A Trampoline Pad, issued Apr. 7, 1998, provides for a method for attaching a pad to a trampoline frame using a tab.

Other trampoline pad systems allowed a different configuration of the pad and spring structure. Inventor Green in U.S. Pat. No. 3,677,368 Issued Jul. 18, 1972, entitled trampoline, provides for a trampoline frame that has a spring suspended construction. A user landing on a trampoline pad attached to the trampoline frame with the spring suspended construction would benefit from the downward yielding movement over a portion of the frame in response to the exertion of a downward impact. Inventor Samuel Chen in U.S. Pat. No. 7,494,144 issued Feb. 24, 2009 entitled Adjustable Trampoline Pad System provides for a trampoline pad system that can be reconfigurable in a modular fashion. While the traditional foam block has been moderately successful, it can still be improved by changing the configuration.

SUMMARY OF THE INVENTION

A trampoline comprising a trampoline frame having legs. The trampoline frame has a trampoline frame horizontal portion. A trampoline bed is suspended across the trampoline frame horizontal portion. Springs extend between the trampoline frame and trampoline bed. An enclosure is connected to the trampoline frame. The enclosure has an enclosure upper support. The enclosure supports an enclosure net. A pad system covers the springs. The pad system includes a wall pad extending upwardly from the springs and terminating at a pad system apex. The pad system further includes a buttress pad connected to the pad system apex at an apex angle from the wall pad, which is defined as an angle between a wall pad outside surface and the buttress pad. The buttress pad extends downwardly to cover at least partially the trampoline frame horizontal portion.

A spring cover extends between the buttress pad and the wall pad. A pad system hollow is formed between the buttress pad and the wall pad and the spring cover. The spring cover is optional and optionally formed as a padded spring cover or as a sheet spring cover. The enclosure net is preferably double layered with an outside enclosure net parallel to an inside enclosure net. The outside enclosure net and the inside enclosure net have a different weave structure, such as if the outside enclosure net has larger net openings than the inside enclosure net. The inside enclosure net preferably has net openings that are less than 1 cm and the outside enclosure net has net openings that are greater than 1 cm. The apex angle is an acute angle that is preferably less than 60°.

Figure 1:
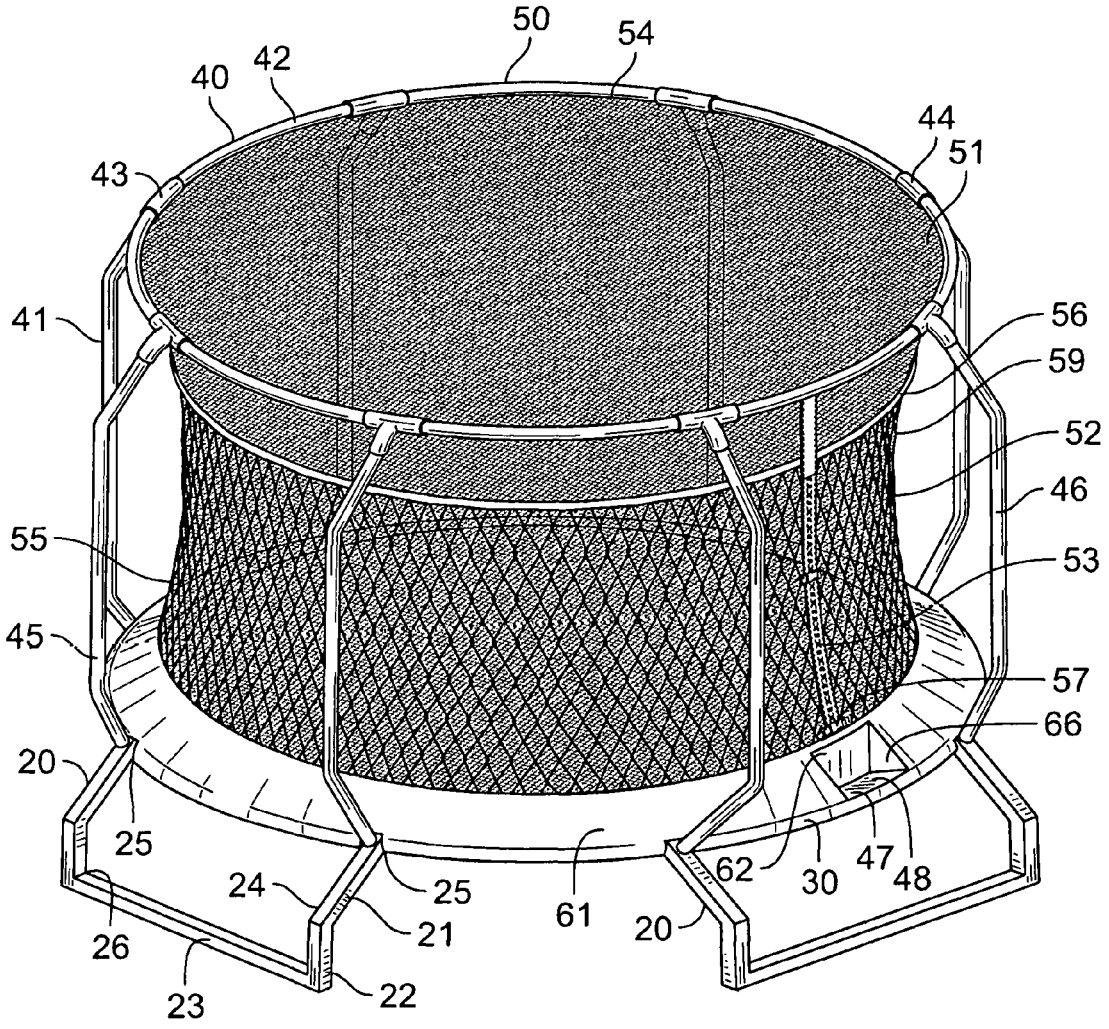
FIG. 1 is a perspective view of trampoline with a trampoline enclosure.
Figure 2:
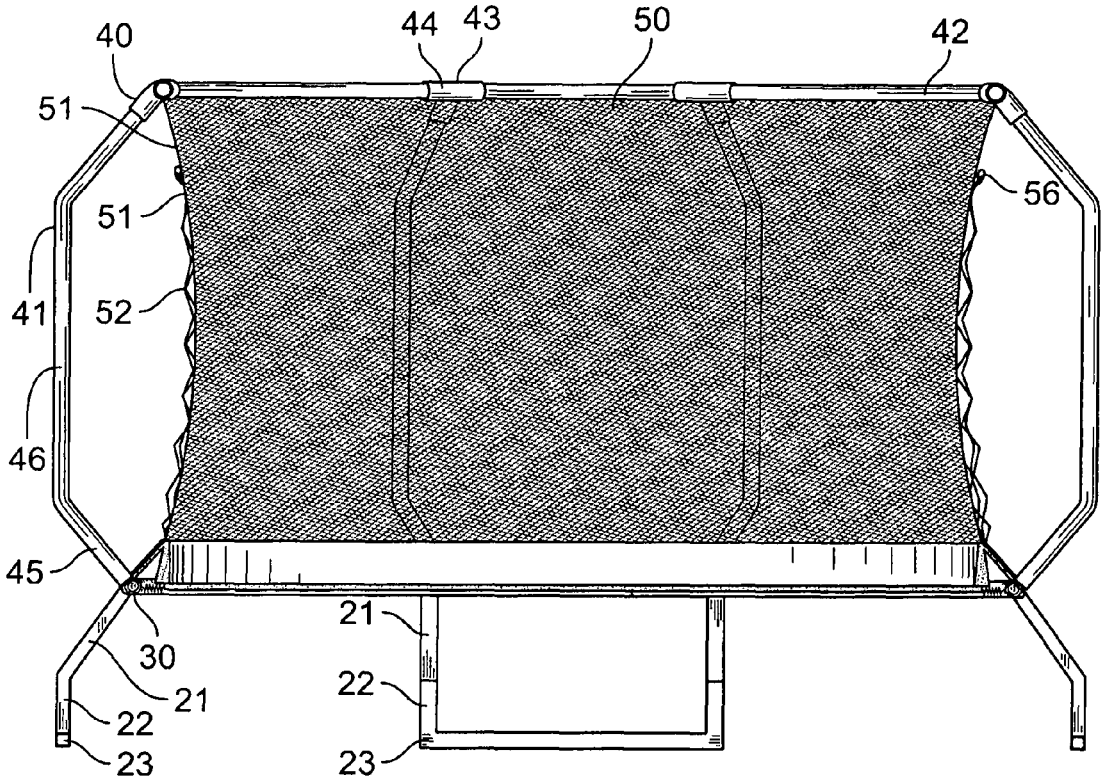
FIG. 2 is a side section view of a trampoline with a trampoline enclosure.
Figure 3:
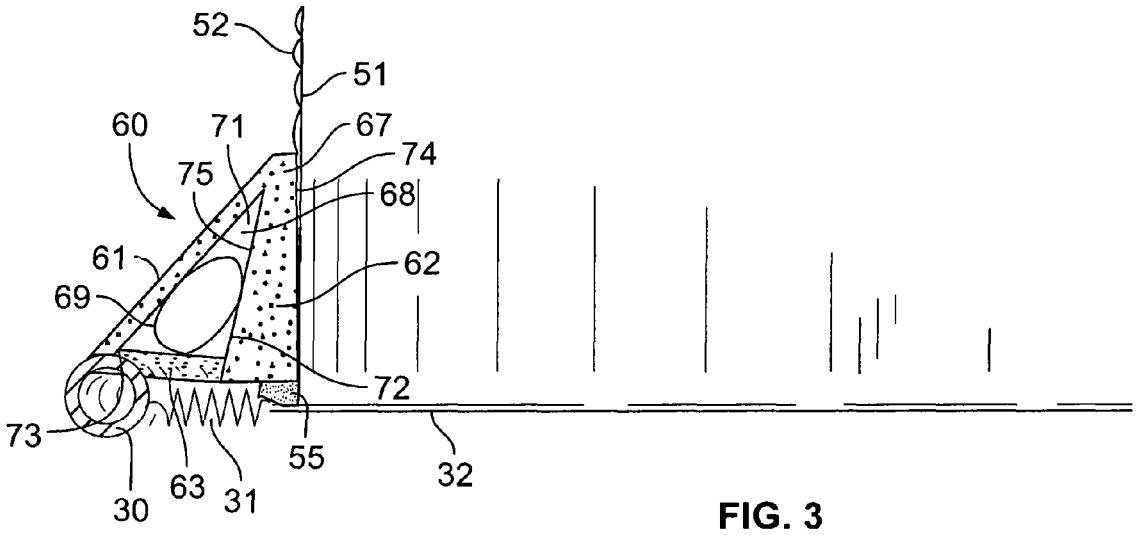
FIG. 3 is a cross section view of the trampoline pad system showing a padded spring cover.
Figure 4:
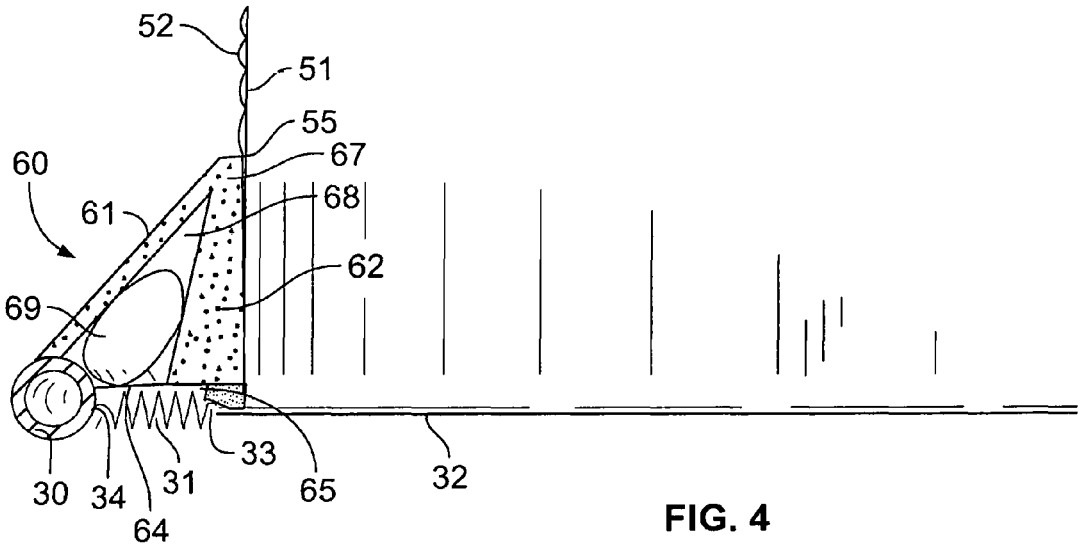
FIG. 4 is a cross section view of the trampoline pad system showing a spring cover pad that is a thin sheet.

The following call out list of elements can be a useful guide in referencing the element numbers of the drawings.

20 Trampoline Leg
21 Leg Angled Portion
22 Leg Vertical Portion
23 Leg Horizontal Portion
25 Lead Frame Connection
26 Leg Base Connection
30 Trampoline Frame Horizontal Portion
31 Spring
32 Bed
33 Spring Inside Connection
34 Spring Outside Connection
40 Enclosure
41 Enclosure Pole
42 Enclosure Upper Support
43 Enclosure Upper Connector
44 Enclosure Connector Receiver
45 Enclosure Pole Lower Connector
46 Pole Vertical Section
47 Indent
48 Step
50 Enclosure Net
51 Inside Enclosure Net
52 Outside Enclosure Net
53 Zipper
54 Enclosure Net Upper Connection
56 Net To Net Interface
57 Buckle
58 Zipper Lead Strip
59 Net Openings
60 Pad System
61 Buttress Pad
62 Wall Pad
63 Padded Spring Cover
64 Sheet Spring Cover
65 Pad System Spring Indent
66 Step Side Pad
67 Pad System Apex
68 Pad System Hollow
69 Inflatable Torus
71 Apex Angle

72 Inside Angle
73 Outside Angle
74 Wall Pad Inside Surface
75 Wall Pad Outside Surface

DETAILED DESCRIPTION OF THE PREFERRED EMBODIMENT

Generally, the trampoline has a trampoline bed 32 suspended on springs 31. Springs 31 attach between the trampoline frame horizontal portion 30 and the trampoline bed 32. The spring inside connection 33 connects the spring 31 to the trampoline bed 32. The spring outside connection 34 connects the spring 31 to the trampoline frame horizontal portion 30. The spring outside connection and the spring inside connection can be formed as hooks formed on both ends of the spring 31. The hook ends can extend into the trampoline frame hollow portion 30, which can be formed as a tube.

The trampoline leg 20 can be formed as a continuous rim, U-shaped members, or as simple vertical posts. The trampoline leg 20 shown in the drawings has a number of sections including a leg angled portion 21 extending at an angle from a leg vertical portion 22. The leg vertical portion 22 is connected to the leg horizontal portion 23 at a leg base connection 26 to define a U-shaped leg member. The trampoline leg 20 connects to the trampoline frame horizontal portion 30 at a leg frame connection 25. The trampoline leg 20 extends slightly beyond the circumferential periphery of the trampoline frame horizontal portion 30

The enclosure 40 is connected to the trampoline frame horizontal portion 30. The enclosure 40 has an enclosure net 50 to retain users within the jumping area of the trampoline bed 32. The trampoline bed 32 has a periphery attached to the springs. The periphery of the trampoline bed is covered by a pad system 60.

The enclosure 40 includes enclosure poles 41 that connect to enclosure upper supports 42 via enclosure upper connectors 43. The enclosure upper connectors preferably have enclosure connector receivers 44 that can be formed as sockets for receiving tubular ends of the enclosure upper support 42. The enclosure pole 41 has an enclosure pole lower connector 45 that connects the enclosure pole 41 to the trampoline frame horizontal portion 30.

The enclosure net upper connection 54 connects the enclosure net 52 the enclosure upper support 42. The enclosure net upper connection 54 can be formed as a sleeve formed on the enclosure net 50. The sleeve can form a hollow long cavity that receives the enclosure net upper support. The enclosure net upper connection 54 can also be stitched to the enclosure upper support 42. The enclosure net preferably can be a double net with a larger aperture outside net and a smaller aperture inside net. The outside net can be tied to or interlaced with the inside net with fabric loops. The outside net preferably has a thicker weave and with stronger material capable of carrying greater linear tension, and the inside net preferably has a thinner weave capable of preventing finger entrapment.

Preferably, the enclosure net 50 includes an outside enclosure net 52 and an inside enclosure net 51. The outside enclosure net 52 has a different weave structure than the inside enclosure net 51. The outside enclosure net 52 is preferably connected to the inside enclosure net 51 at a net to net interface 56. The net to net interface 56 is formed as a strip that passes around the circumference of the enclosure 40. The inside enclosure net can have net openings 59 that are less than 1 cm and the outside enclosure net can have net openings 59 that are greater than 1 cm.

A zipper 53 is preferably formed through both layers, namely the outside enclosure net 52 and the inside enclosure net 51. The zipper 53 is sewn to both the outside enclosure net 52 and the inside enclosure net 51. The zipper 53 has a zipper lead strip 58. The zipper lead strip 58 is also sewn to the inside enclosure net 51 and the outside enclosure net 52. The zipper lead strip 58 can also be sewn to the net to net interface 56. The zipper 53 can be supplemented or replaced by a set of buckles 57. The buckles 57 can be placed at a bottom or lower edge of the enclosure net 50 or at a middle of the enclosure net 50.

When entering the zippered opening of the enclosure 40, a user can use a step 48. The step 48 is formed on an indent 47. The step 48 can be made of a plank or thick sheet of plastic such as high density polyethylene. It could also be made of wood or steel, but a thick plastic sheet is preferred. The step 48 when made as a plank preferably overlies the springs to allow a user a safe entry. The plank can be enclosed in a foam pad and placed inside a fabric cover.

The indent can be supported by a step side pad is six and a wall pad 62. The indent is formed between the pair of step side pads 66 which are triangular shaped side pads. The enclosure net is preferably connected to the net lower connection 55 either at the pad system apex 67 or lower near the spring inside connection 33.

The pad system 60 can be padded or just a thin sheet. The pad system 60 includes a wall pad 62 that extends upwardly from the bed 32. The wall pad 62 has a supplemental support of a buttress pad 61. The buttress pad 61 has a larger diameter than the wall pad 62 and is angled toward the wall pad 62 so that the buttress pad 61 connects to the wall pad 62 at a pad system apex 67. The pad system apex 67 joins the buttress pad 61 with the wall pad 62 to form a pad frame. The pad frame is formed of pad material which can be foam or sheeting or both in a combination such as a laminate construction. The foam is preferably covered by the sheeting. The buttress pad 61 and the wall pad 62 have a pad system hollow 68 formed between the buttress pad 61 and the wall pad 62. The pad system hollow 68 has space for receiving an inflatable torus 63 that can be formed as a bladder that can be made in sections and inserted into the pad system hollow 68. The cross-section of the pad system hollow 68 is generally triangular, and the pad system 60 also generally has a triangular cross section.

When a user falls on the pad system, the user contacts the pad system apex 67. The pad system apex 67 supports the user resiliently to push the user away from the trampoline frame horizontal portion 30. The lower end of the buttress pad 61 and the lower end of the wall pad 62 are preferably connected together by a sheet spring cover 64 or by a padded spring cover 63.

The triangular cross section of the pad system 60 produces a variety of geometric configurations that have definable measurements including an apex angle 71. The apex angle 71 is an angle of the surfaces of the buttress pad 61 and the wall pad 62. The inside angle 72 is the angle between the padded spring cover 63 and the wall pad 62. The outside angle 73 is the angle between the buttress pad 61 and the padded spring cover 63. The wall pad inside surface 74 is the inside surface of the wall pad that faces the trampoline bed 32. The wall pad outside surface 75 is the outside surface of the wall pad that faces the buttress pad 61. The apex angle 71 is taken between the wall pad outside surface 75 and the buttress pad 61 inside surface. The apex angle 71 is preferably acute and preferably less than 60°. The height of the wall pad 62 is longer than the spring 31 when the spring 31 is not in an elongated position but rather is in a neutral resting position.

The wall pad preferably includes a lower extension that forms a pad system spring indent 65 that fits over at least a portion of the spring 31. The pad system spring indent 65 conforms to a profile of the spring 31.

The trampoline pad is formed of a pair of annular flexible foam members. Each of the flexible foam members are attached to each other at a folding junction. The foam members can be encapsulated within a fabric shell. Thus, when a user falls on the pad system and contacts the pad system apex 67, the pad system apex 67 folds over the spring 31 and trampoline horizontal frame tube 30. The folding action resists force because it requires a deformation of the entire pad system. Also, the folding action optionally compresses the inflatable member 69.

A variety of different special visual effects can be accomplished by the different net weaving, such as by having different color nets, or by painting one of the nets with glow-in-the-dark paint. The nets can also have a visually cooperating overlay for enabling overlaid designs.

The invention claimed is:

1. A trampoline comprising:

a. a trampoline frame having legs, wherein the trampoline frame has a trampoline frame horizontal portion;

b. a trampoline bed suspended across the trampoline frame horizontal portion;

c. springs extending between the trampoline frame and trampoline bed;

d. an enclosure connected to the trampoline frame, wherein the enclosure has an enclosure upper support, wherein the enclosure supports an enclosure net; and e. a pad system covering the springs, wherein the pad system includes a wall pad extending upwardly from the springs and terminating at a pad system apex, and wherein the pad system further includes a buttress pad connected to the pad system apex at an apex angle from the wall pad, which is defined as an angle between a wall pad outside surface and the buttress pad, wherein the buttress pad extends downwardly to cover at least partially, the trampoline frame horizontal portion, wherein the enclosure net is double layered with an outside enclosure net parallel to an inside enclosure net, wherein the outside enclosure net and the inside enclosure net have a different weave structure.

2. The trampoline of claim 1, further including a spring cover extending between the buttress pad and the wall pad, wherein a pad system hollow is formed between the buttress pad and the wall pad and the spring cover.

3. The trampoline of claim 2, wherein the spring cover is formed as a padded spring cover.

4. The trampoline of claim 2, wherein the spring cover is formed as a sheet spring cover.

5. The trampoline of claim 1, wherein the outside enclosure net has larger net openings than the inside enclosure net.

6. The trampoline of claim 5, wherein the inside enclosure net has net openings that are less than 1 cm and the outside enclosure net has net openings that are greater than 1 cm.

7. The trampoline of claim 1, wherein the apex angle is an acute angle that is less than 60°.

8. The trampoline of claim 7, further including a spring cover extending between the buttress pad and the wall pad, wherein a pad system hollow is formed between the buttress pad and the wall pad and the spring cover.

9. The trampoline of claim 8, wherein the spring cover is formed as a padded spring cover.

10. The trampoline of claim 9, wherein the spring cover is formed as a sheet spring cover.

11. The trampoline of claim 9, wherein the enclosure net is double layered with an outside enclosure net parallel to an inside enclosure net, wherein the outside enclosure net and the inside enclosure net have a different weave structure.

12. The trampoline of claim 11, wherein the outside enclosure net has larger net openings than the inside enclosure net.

13. The trampoline of claim 11, wherein the inside enclosure net has net openings that are less than 1 cm and the outside enclosure net has net openings that are greater than 1 cm.

14. The trampoline of claim 1, further including a step, wherein the step is formed as a plank and forms a part of the spring cover, wherein the step is located over the springs.

15. A trampoline comprising:

a. a trampoline frame having legs, wherein the trampoline frame has a trampoline frame horizontal portion;

b. a trampoline bed suspended across the trampoline frame horizontal portion;

c. springs extending between the trampoline frame and trampoline bed;

d. an enclosure connected to the trampoline frame, wherein the enclosure has an enclosure upper support, wherein the enclosure supports an enclosure net; and e. a pad system covering the springs, wherein the enclosure net is double layered with an outside enclosure net parallel to an inside enclosure net.

16. The trampoline of claim 15, wherein the outside enclosure net and the inside enclosure net have a different weave structure.

17. The trampoline of claim 16, wherein the outside enclosure net has larger net openings than the inside enclosure net.

18. The trampoline of claim 17, wherein the inside enclosure net has net openings that are less than 1 cm and the outside enclosure net has net openings that are greater than 1 cm.

* * * * *